US011390420B2

(12) United States Patent
Simpkins et al.

(10) Patent No.: US 11,390,420 B2
(45) Date of Patent: Jul. 19, 2022

(54) RETAIL READY HARNESS STYLE WRAP AROUND SPLIT CASE

(71) Applicants: WestRock Shared Services, LLC, Atlanta, GA (US); Bellisio Foods, Inc., Minneapolis, MN (US)

(72) Inventors: Kevin M. Simpkins, Cumming, GA (US); Matthew Woodard Lorence, Plymouth, MN (US)

(73) Assignees: WestRock Shared Services, LLC, Atlanta, GA (US); Bellisio Foods, Inc., Minneapolis, MN (US)

( * ) Notice: Subject to any disclaimer, the term of this patent is extended or adjusted under 35 U.S.C. 154(b) by 73 days.

(21) Appl. No.: 16/369,785

(22) Filed: Mar. 29, 2019

(65) Prior Publication Data

US 2020/0307852 A1 Oct. 1, 2020

(51) Int. Cl.
*B65D 5/54* (2006.01)
*B65D 5/42* (2006.01)

(52) U.S. Cl.
CPC ..... *B65D 5/5445* (2013.01); *B65D 5/4266* (2013.01)

(58) Field of Classification Search
CPC .. B65D 5/5445; B65D 5/4266; B65D 5/4608; B65D 5/02
USPC ..... 206/774, 736; 229/237
See application file for complete search history.

(56) References Cited

U.S. PATENT DOCUMENTS 4,058,206 A * 11/1977 Morse ..... B65D 5/52 229/241
5,857,570 A * 1/1999 Brown ..... B65D 5/46072 206/427
5,921,398 A * 7/1999 Carroll ..... B65D 5/5253 206/736
5,927,498 A * 7/1999 Saam ..... B65D 5/52 206/499
6,073,833 A * 6/2000 Desrosiers ..... B65D 5/5445 229/235
6,129,211 A * 10/2000 Prakken ..... B65D 5/5253 206/526
6,523,692 B2 * 2/2003 Gregory ..... B65D 5/5253 206/746
7,021,468 B2 * 4/2006 Cargile, Jr. ..... B65B 5/061 206/746

(Continued)

FOREIGN PATENT DOCUMENTS

JP H06-069122 U 9/1994
JP 2002274530 A 9/2002

(Continued)

OTHER PUBLICATIONS

PCT International Search Report and Written Opinion dated Jul. 21, 2020, issued during the proseuction of PCT International Patent Application No. PCT/US2020/025782.

(Continued)

*Primary Examiner* — Chun Hoi Cheung

(74) *Attorney, Agent, or Firm* — Locke Lord LLP; Alicia J. Carroll; Gabby Gelozin

(57) ABSTRACT

A retail ready package configured for division into two separate product display cases is disclosed wherein two rows of products are arranged side-by-side within the package in a vertical front facing display orientation relative to the left and right lower front panels of the package.

16 Claims, 9 Drawing Sheets

(56) References Cited

U.S. PATENT DOCUMENTS

| | | | | |
|---|---|---|---|---|
| 7,225,930 | B2 * | 6/2007 | Ford | B65D 5/5445 206/746 |
| 8,028,839 | B2 * | 10/2011 | Learn | B65D 5/504 206/774 |
| 8,740,054 | B2 * | 6/2014 | Pinkstone | B65D 5/0015 229/242 |
| 9,187,207 | B2 * | 11/2015 | Gessler, Jr | B65D 5/4608 |
| 9,809,349 | B2 | 11/2017 | Gessler, Jr. et al. | |
| 9,938,040 | B2 * | 4/2018 | Buscema | B31B 50/812 |
| 2005/0184139 | A1 * | 8/2005 | Gasior | B65D 5/52 229/240 |
| 2006/0006096 | A1 | 1/2006 | Funk | |
| 2006/0266815 | A1 * | 11/2006 | Coltri-Johnson | B65D 5/445 229/242 |
| 2009/0302098 | A1 | 12/2009 | Learn | |
| 2014/0216981 | A1 * | 8/2014 | Kuhn | B65D 5/542 206/736 |
| 2018/0065774 | A1 | 3/2018 | Gessler, Jr. et al. | |
| 2018/0305069 | A1 * | 10/2018 | Keefe, Jr. | B65D 5/5445 |
| 2019/0023449 | A1 | 1/2019 | Barton et al. | |
| 2019/0322412 | A1 * | 10/2019 | Couture | B31B 50/624 |
| 2020/0017256 | A1 * | 1/2020 | Hermosillo | B65D 5/5226 |
| 2020/0223581 | A1 * | 7/2020 | Lohoff | B65D 5/542 |

FOREIGN PATENT DOCUMENTS

| | | | |
|---|---|---|---|
| JP | 2013224171 | A | 10/2013 |
| KR | 20090000139 | U | 1/2009 |
| KR | 20130004164 | U | 7/2013 |

OTHER PUBLICATIONS

PCT International Search Report and Written Opinion dated Jul. 24, 2020, issued during the prosecution of PCT International Patent Application No. PCT/US2020/025741.

* cited by examiner

RETAIL READY HARNESS STYLE WRAP AROUND SPLIT CASE

BACKGROUND OF THE INVENTION

1. Field of the Invention

The subject invention is directed to product packaging, and more particularly, to a retail ready harness style wrap around case configured to be split in half for displaying products in two separate display cases.

2. Description of Related Art

Retailers, such as big-box stores, superstores and warehouse clubs sell large quantities of fast moving consumer goods. These retailers often want to have items shipped from their distribution centers to stores in unit loads and bulk boxes that can be stocked without handling of the merchandise.

The goal for corrugated shipping containers is to put case goods directly onto shelves and stocking locations without individually handling the unit packs or primary packages. To this end, retailers often require products to come in shelf ready packaging to reduce stocking costs and save labor expenses. Shelf ready packaging, also known as, retail ready packaging refers to the packaging of a product so that it is delivered to a retailer in a manner optimized for efficient stocking and sale.

Some retailers prefer to ship carded products, such as blister packs and frozen foods, in two separate rows arranged in a side-by-side orientation. However, this orientation presents problems when displaying the products on a shelf so that they are aesthetically pleasing and readily accessible to a customer. Thus, it would be beneficial to provide a retail ready package that is adapted and configured for displaying two separate rows of products that are arranged side-by-side in a vertical front facing display orientation for ready access by a consumer. The subject invention provides for such a package.

SUMMARY OF THE DISCLOSURE

The subject invention is directed to a retail ready package configured for division into two separate product display cases wherein two rows of products are arranged side-by-side within the package in a vertical front facing display orientation relative to the left and right lower front panels of the package.

More particularly, the subject invention is directed to a blank for constructing a retail ready package configured for division into two separate product display cases, which includes left and right lower front panels separated from one another by a shaped front notch, left and right bottom panels respectively foldably connected to the left and right lower front panels along a lower front horizontal fold line and separated from one another along a bottom vertical perforation line, and left and right lower rear panels respectively foldably connected to the left and right bottom panels along a lower rear horizontal fold line and separated from one another along a lower rear vertical perforation line.

The blank further includes an upper rear panel separably connected to the left and right lower rear panels along a shaped upper rear cut line, a top panel foldably connected to the upper rear panel along an upper rear horizontal fold line, and an upper front panel foldably connected to the top panel along an upper front horizontal fold line.

In accordance with a preferred embodiment of the subject invention, the upper rear panel, the top panel and the upper front panel are adapted and configured to be separated from the left and right lower front panels, the left and right bottom panels and the left and right lower rear panels along the shaped upper rear cut line associated with the upper rear panel. Furthermore, the left lower front panel, the left bottom panel and the left lower rear panel are adapted and configured to be divided from the right lower front panel, the right bottom panel and the right lower rear panel along the bottom vertical perforation line and the lower rear vertical perforation line to form two separate product display cases.

The left and right lower front panels have respective left and right lower front side flaps foldably connected thereto, the left and right bottom panels have respective left and right bottom side flaps foldably connected thereto, the left and right lower rear panels have respective left and right lower rear side flaps foldably connected thereto, and the upper rear panel has left and right upper rear side flaps foldably connected thereto.

Furthermore, the left and right upper rear side flaps are separated from the left and right lower rear side flaps by continuations of the shaped upper rear cut line associated with the upper rear panel. In addition, the top panel has left and right top side flaps foldably connected thereto and the upper front panel has left and right upper front side flaps foldably connected thereto. Preferably, the upper front panel has a front recessed access area formed in an upper edge thereof, wherein the recessed area aligns with the shaped front notch separating the left and right lower front panels.

These and other features of the retail ready package of the subject invention will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those skilled in the art will readily understand how to make and use the retail ready package of the subject invention without undue experimentation, preferred embodiments thereof will be described in detail herein below with reference to the figures wherein.

DETAILED DESCRIPTION OF THE PREFERRED EMBODIMENTS

Figure 1:
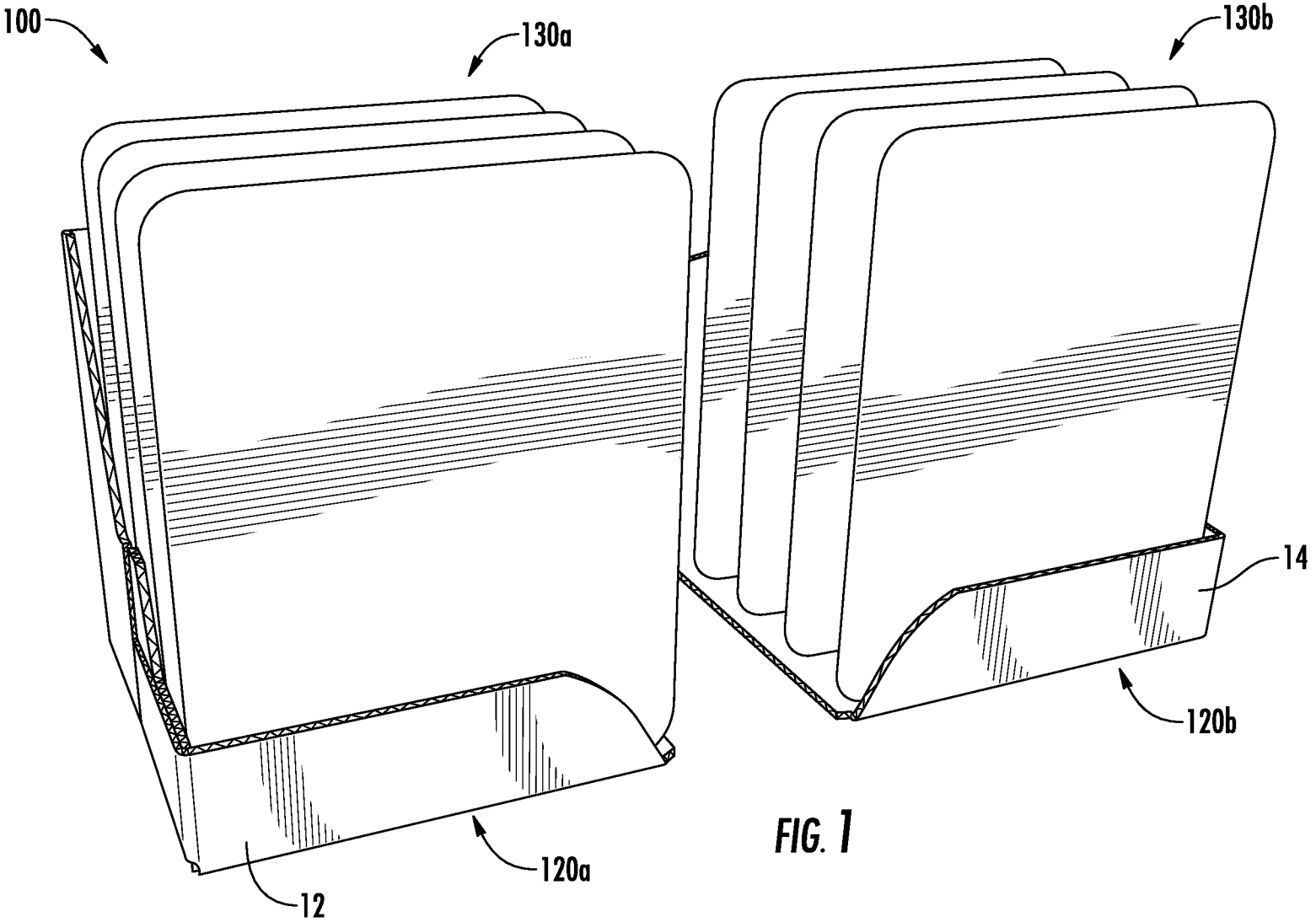
FIG. 1 is a perspective view of the display configuration of the retail ready package of the subject invention, which is split into two separate product display cases.

Referring now to the drawings wherein like reference numerals identify similar structural features or elements of the subject invention, there is illustrated in FIG. 1 a retail ready package 100 for shipping and displaying products, and more particularly, a harness wrap style retail ready package configured for division into two separate product display cases 120*a* and 120*b*, wherein two rows of products 130*a* and 130*b* are arranged side-by-side within the package in a vertical front facing display orientation relative to the left and right lower front panels 12 and 14 of the package, as best seen in FIG. 1.

Figure 2:
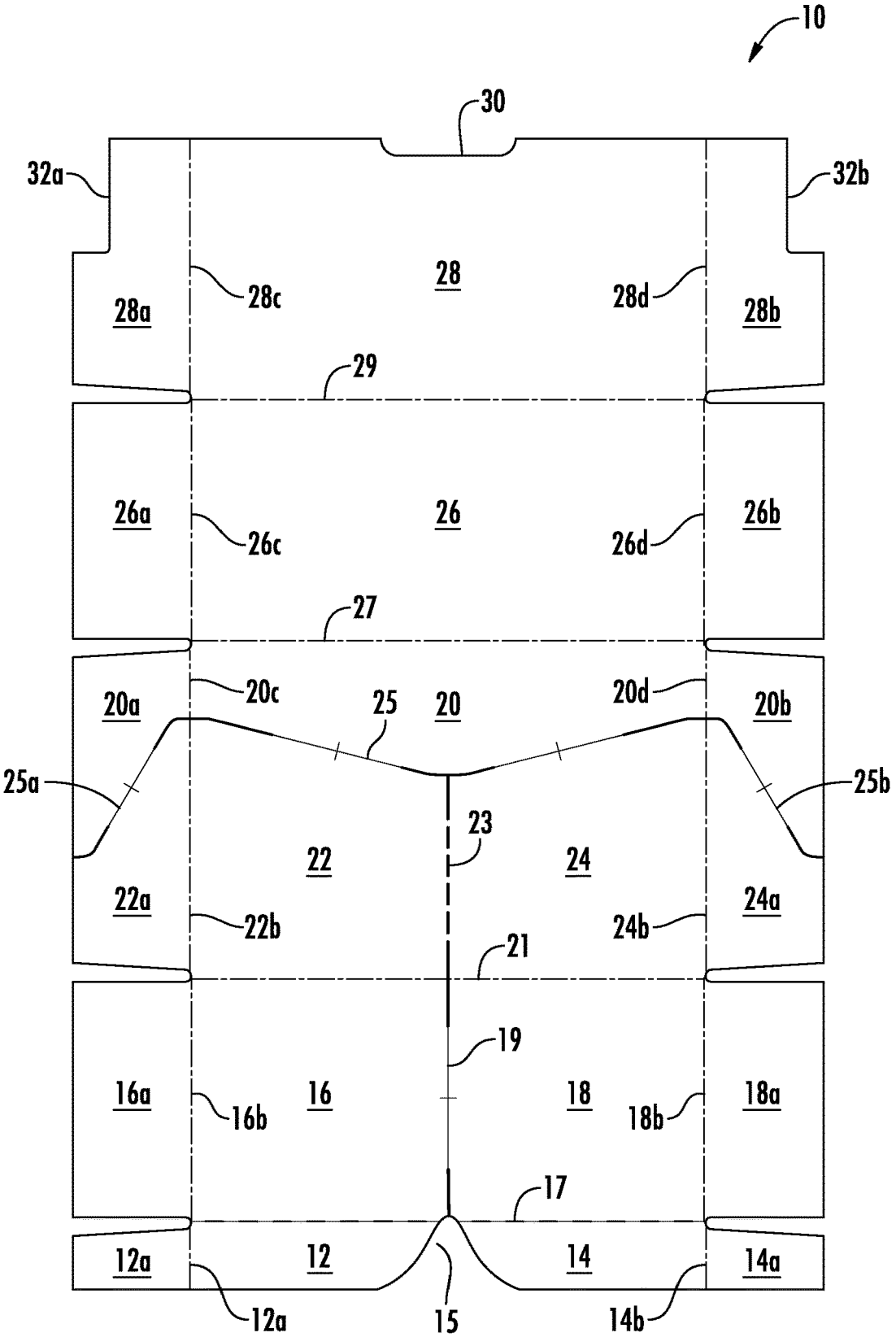
FIG. 2 is a top plan view of a blank for forming the retail ready package of the subject invention, which includes a removable portion and a display portion.

Referring to FIG. 2, there is illustrated a blank for forming the retail ready package of the subject invention, which his designated generally by reference numeral 10. The blank 10 is preferably formed from a die cut corrugated cardboard sheet or a similar material. In the description that follows, the panels of the blank 10 are described relative to the display orientation of a fully constructed package, as opposed to the shipping orientation of the package. Moreover, as explained in more detail below, in the shipping orientation, which is shown for example in FIG. 5, the front of the package faces upward, rather than forward, as it would on a shelf, as previously shown in FIG. 1.

The blank 10 includes left and right lower front panels 12 and 14 separated from one another by a shaped front notch 15. The left and right lower front panels 12 and 14 have respective left and right lower front side flaps 12*a* and 14*a* that are foldably connected thereto along respective fold line 12*b* and 14*b*. Left and right bottom panels 16 and 18 are respectively foldably connected to the left and right lower front panels 12 and 14 along a lower front horizontal fold line 17 and they are separated from one another along a bottom vertical perforation line 19. The left and right bottom panels 16 and 18 have respective left and right bottom side flaps 16*a* and 18*a* foldably connected thereto along respective vertical fold lines 16*b* and 18*b*.

The blank 10 further includes left and right lower rear panels 22 and 24 respectively foldably connected to the left and right bottom panels 16 and 18 along a lower rear horizontal fold line 21 and they are separated from one another along a lower rear vertical perforation line 23. The left and right lower rear panels 22 and 24 have respective left and right lower rear side flaps 22*a* and 24*a* foldably connected thereto along respective vertical fold lines 22*b* and 24*b*.

An upper rear panel 20 is separably connected to the left and right lower rear panels 22 and 24 along a shaped upper rear cut line 25. The upper rear panel 20 has left and right upper rear side flaps 20*a* and 20*b* foldably connected thereto along respective fold lines 20*c* and 20*d*. The left and right upper rear side flaps 20*a* and 20*b* are separated from the left and right lower rear side flaps 22*a* and 24*a* by respective left and right continuations 25*a* and 25*b* of the shaped upper rear cut line 25 associated with the upper rear panel 20.

The blank 10 also includes a top panel 26 that is foldably connected to the upper rear panel 20 along an upper rear horizontal fold line 27, and an upper front panel 28 foldably connected to the top panel 26 along an upper front horizontal fold line 29. The top panel 26 has left and right top side flaps 26*a* and 26*b* foldably connected thereto along respective fold lines 26*c* and 26*d*, and the upper front panel 28 has left and right upper front side flaps 28*a* and 28*b* foldably connected thereto along respective fold lines 28*c* and 28*d*. The left and right upper front side flaps 28*a* and 28*b* are formed with lateral cut-outs 32*a* and 32*b* that define hand hold areas for carrying the fully erected and loaded retail ready package 100 of the subject invention, as shown for example in FIG. 5.

Figure 5:
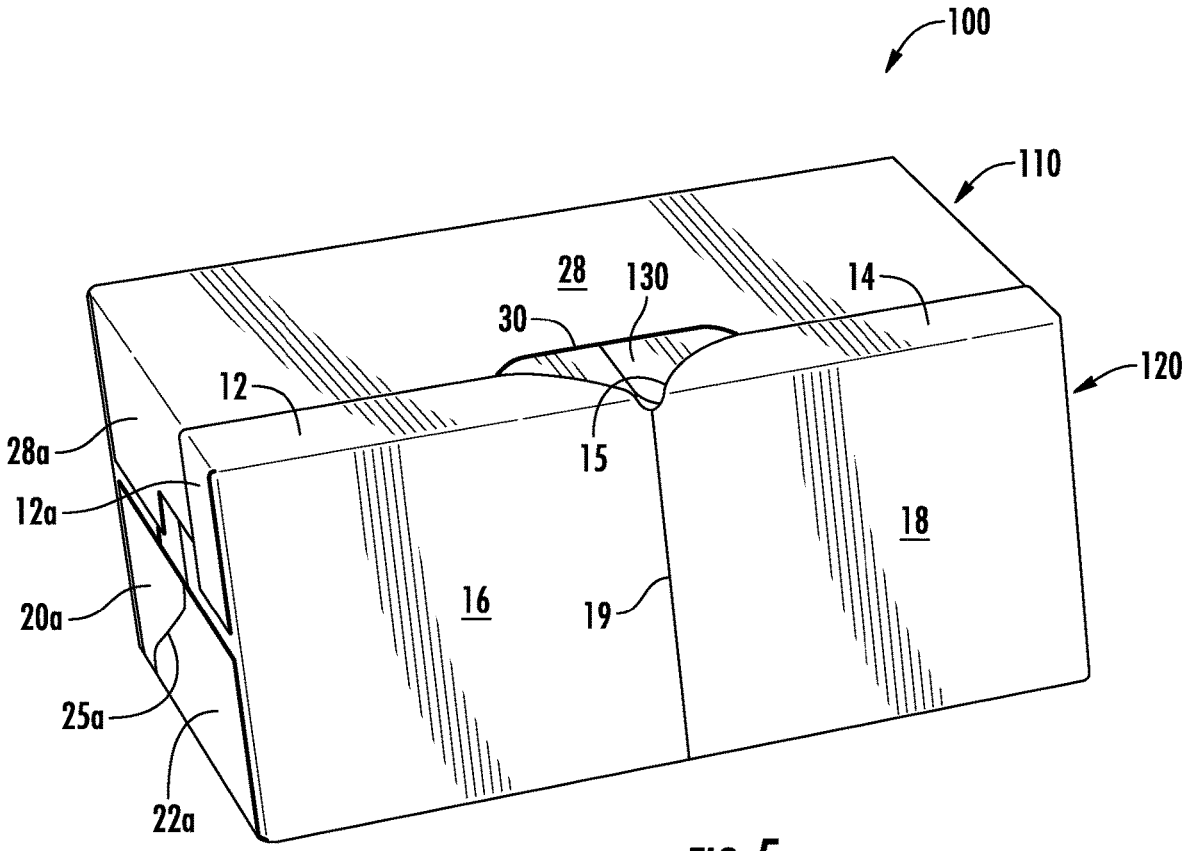
FIG. 5 is a perspective view of the retail ready package of the subject invention in a fully loaded shipping condition.

Preferably, the upper front panel 28 has a front recessed access area 30 formed in an upper edge thereof, wherein the recessed area 30 aligns with the shaped front notch 15 that separates the left and right lower front panels 12 and 14 from one another, as shown in FIG. 5. Together, the recessed area 30 and notch 15 form an opening where the removable portion 110 of the package 100 can be separated from the display portion 120 of the package 100.

Figure 6:
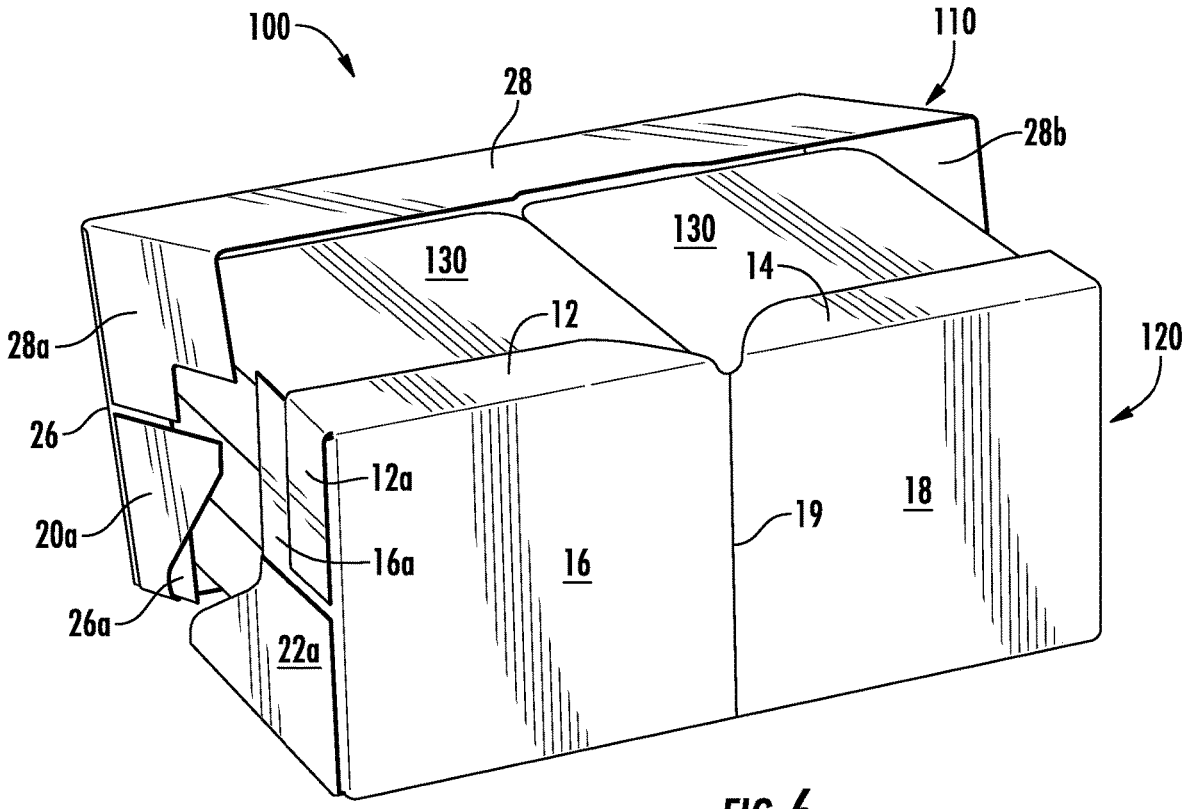
FIG. 6 is a perspective view of the retail ready package of the subject invention as the removable portion of the package is being separated from the display portion of the package, while the package is in its shipping orientation with products facing upward.
Figure 7:
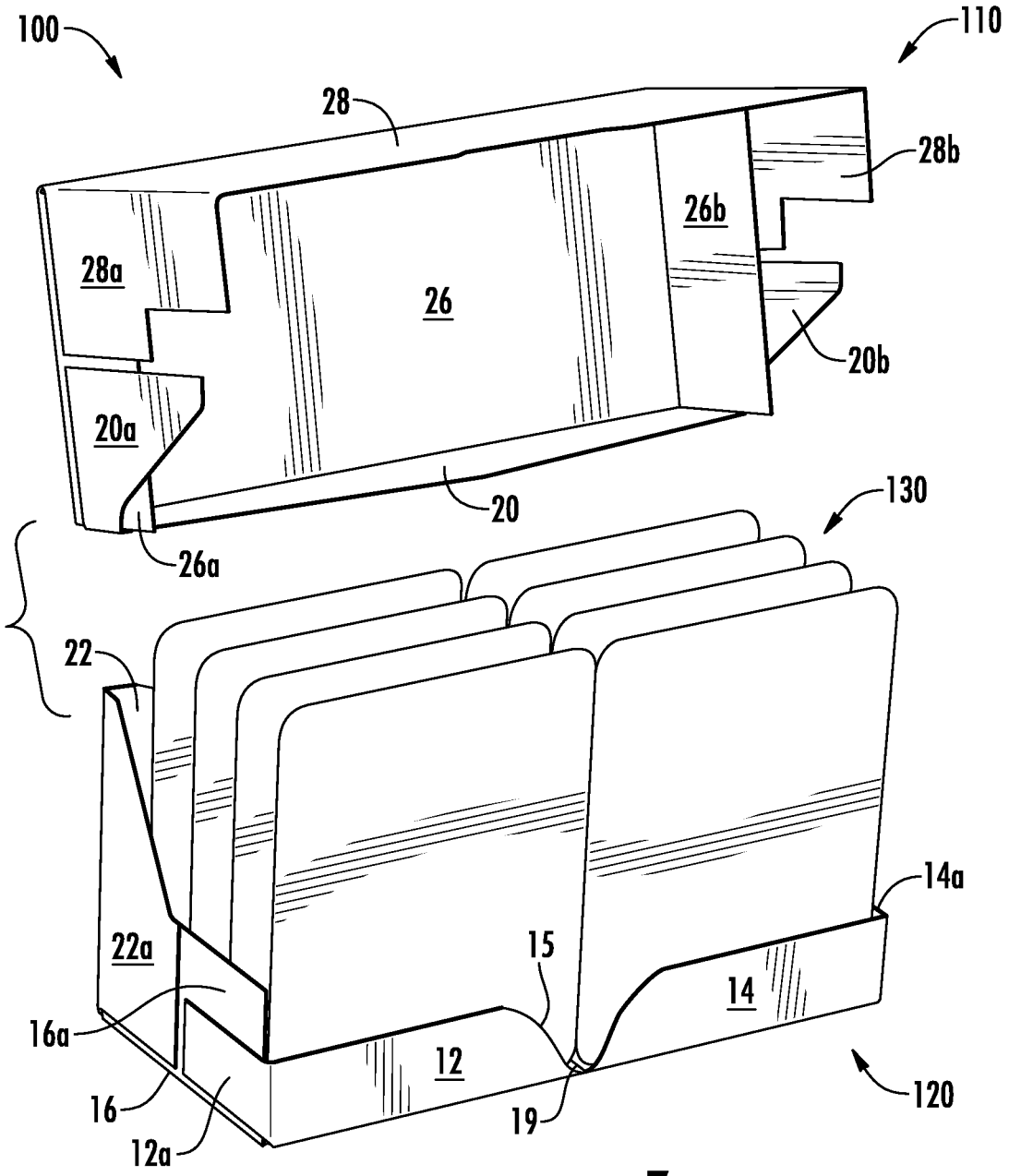
FIG. 7 is a perspective view of the retail ready package of the subject invention with the removable portion of the package completely separated from the display portion of the package, and wherein the package is in its display orientation with products facing forward.
Figure 8:
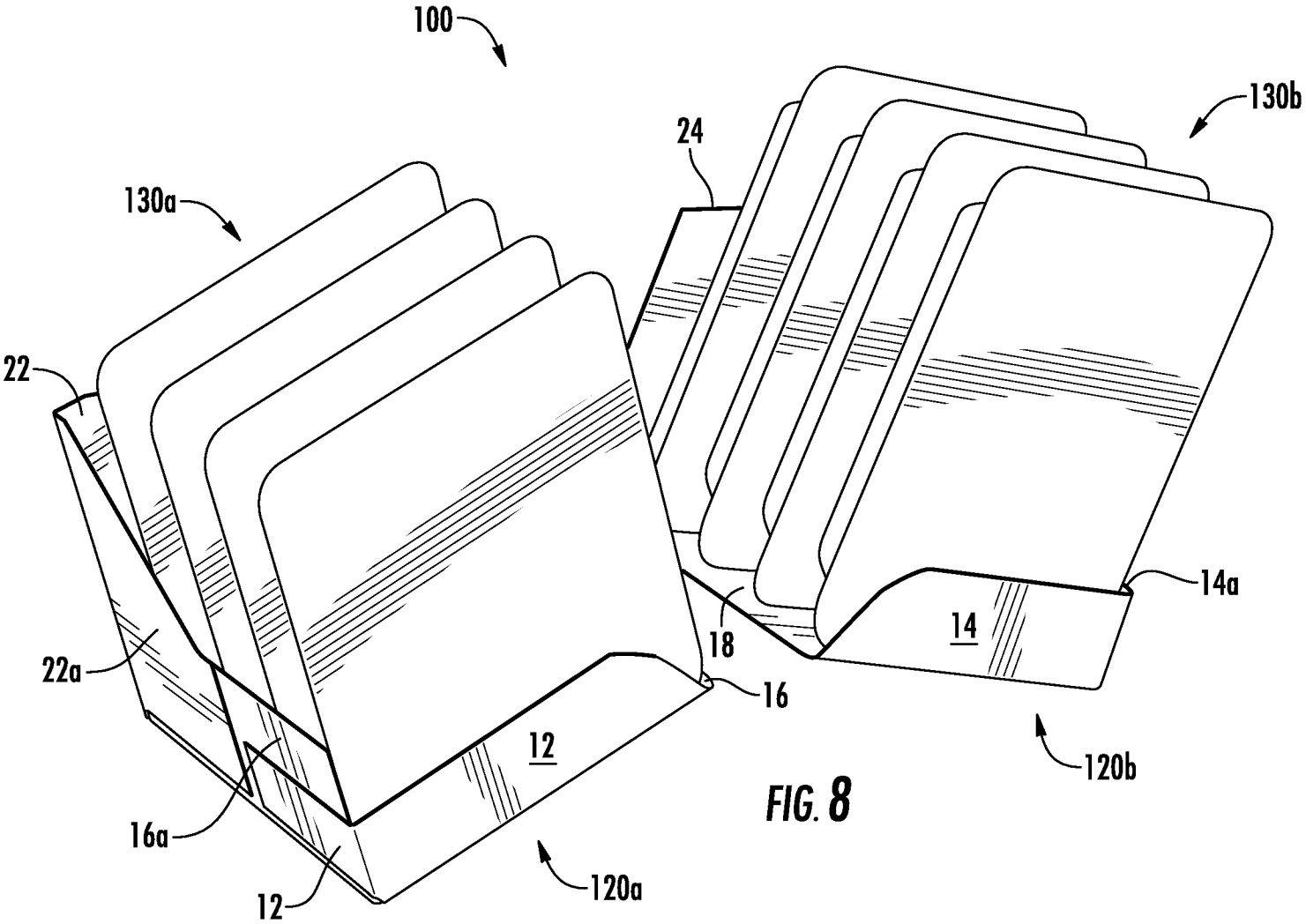
FIG. 8 is a perspective view of the display portion of the retail ready package of the subject invention as the display portion of the package is split into two separate display cases.
Figure 9:
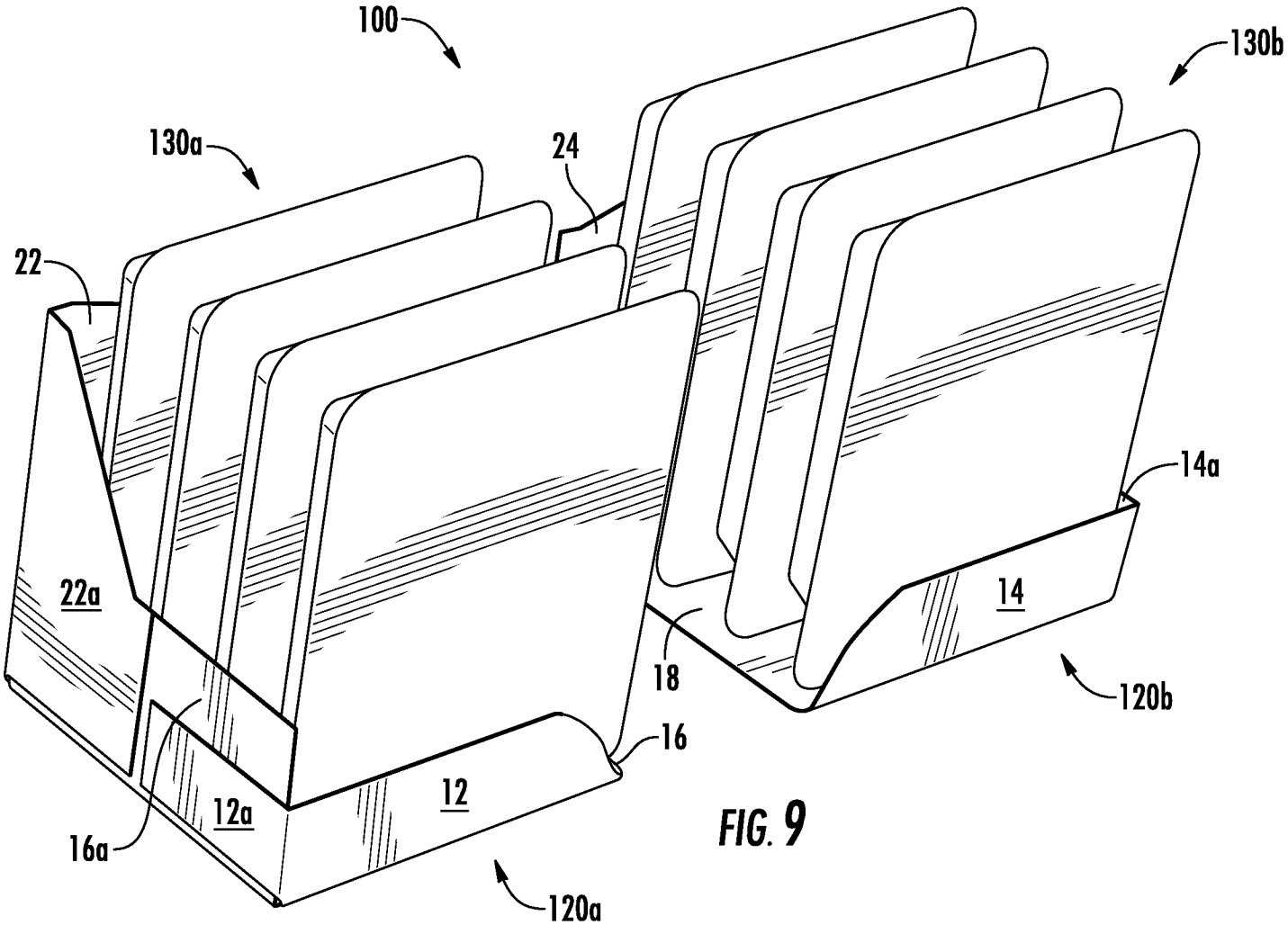
FIG. 9 is a perspective view of the display configuration of the retail ready package of the subject invention divided into two separate product display cases wherein two rows of products are arranged side-by-side in a vertical front facing display orientation.

More particularly, in accordance with a preferred embodiment of the subject invention, as best seen in FIGS. 6 and 7, the upper rear panel 20, the top panel 26 and the upper front panel 28 are adapted and configured to be separated from the left and right lower front panels 12 and 14, the left and right bottom panels 16 and 18, and the left and right lower rear panels 22 and 24 along the shaped upper rear cut line 25 associated with the upper rear panel 20. Furthermore, the left lower front panel 12, the left bottom panel 16 and the left lower rear panel 22 are adapted and configured to be divided from the right lower front panel 14, the right bottom panel 18 and the right lower rear panel 24 along the bottom vertical perforation line 19 and the lower rear vertical perforation line 23 to form two separate product display cases, as shown in FIGS. 8 and 9.

Figure 3:
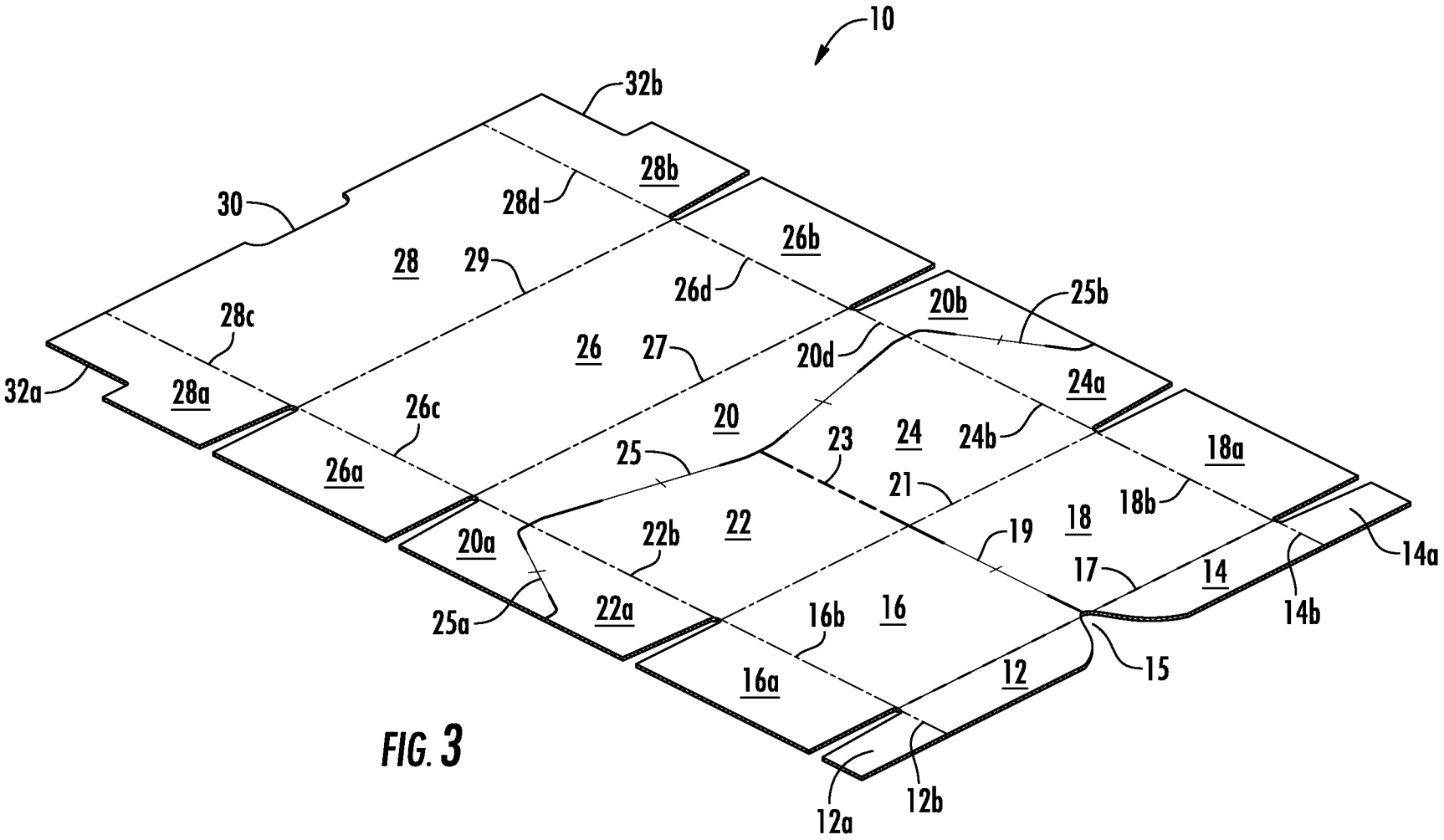
FIG. 3 is a perspective view of the blank for forming the retail ready package of the subject invention, which includes a removable portion and a display portion.
Figure 4:
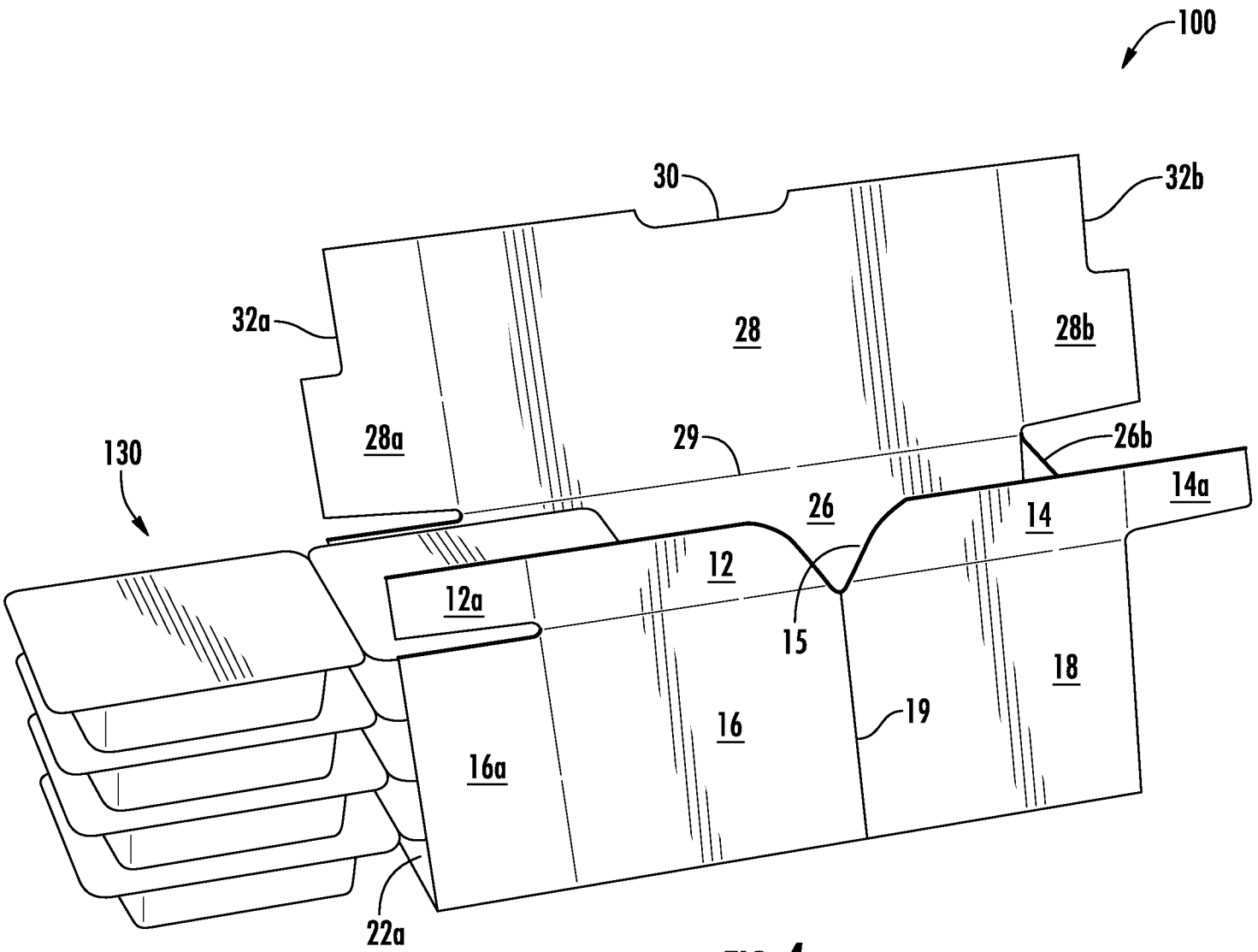
FIG. 4 is a perspective view of the retail ready package of the subject in a partially formed product loading condition.

Referring now to FIGS. 3 and 4, to erect the retail ready package 100 of the subject invention from the die cut blank 10, the left and right bottom panels 16 and 18 are folded relative to the left and right lower rear panels 22 and 24 along the lower front horizontal fold line 17, and the top panel 26 is folded relative to the upper rear panel 20 along the upper rear horizontal fold line 27. At such a time, two rows of products can be loaded into the partially erected package 100 in side-by-side relationship, as best seen in FIG. 4.

Thereafter, to fully erect the retail ready package 100 for shipping, the upper front panel 28 is folded relative to the top panel 26 along the upper front horizontal fold line 29, and left and right lower front panels 12 and 14 are folded relative to the left and right bottom panels 16 and 18 along the lower front horizontal fold line 17. Then, the side flaps of each of the panels are folded into place and glued, so as to fully form the package 100, as shown in FIG. 5. More particularly, side flaps 16*a*, 18*b*, 26*a* and 26*b* form interior side flaps of the package, while side flaps 12*a*, 14*a*, 20*a*, 20*b*, 22*a*, 24*a* 28*a* and 28*b* form exterior side flaps of the package 100.

To prepare the retail ready package 100 of the subject invention for display, whereby the removable portion 110 of the package 100 can be separated from the display portion 120 of the package 100, the package 100 should be in its shipping orientation with products 130 facing upward as shown in FIG. 5. Then, as shown in FIG. 6, the upper rear panel 20, the top panel 26 and the upper front panel 28 are separated from the left and right lower front panels 12 and 14, the left and right bottom panels 16 and 18, and the left and right lower rear panels 22 and 24 along the shaped upper rear cut line 25 and the left and right cut line continuations 25*a* and 25*b*.

Thereafter, the display portion 120 of the retail ready package 100 with the products 130 therein, is repositioned into a display orientation shown in FIG. 7, wherein the left and right lower front panels 12 and 14 are facing forward, with the package seated on the left and right bottom panels 16 and 18. At such a time, the left lower front panel 12, the left bottom panel 16 and the left lower rear panel 22 are divided from the right lower front panel 14, the right bottom panel 18 and the right lower rear panel 24 along the bottom vertical perforation line 19 and the lower rear vertical perforation line 23 to form two separate product display cases 120*a* and 120*b*, as shown in FIG. 8. Thereupon, as shown in FIG. 9, the two separate product display cases 120*a* and 120*b* are retail ready with two rows of products 130*a* and 130*b* arranged side-by-side in a vertical front facing display orientation.

While the subject disclosure has been shown and described with reference to preferred embodiments, those skilled in the art will readily appreciate that changes or modifications may be made thereto without departing from the spirit or scope of the subject disclosure.

What is claimed is:

1. A blank for constructing a retail ready package configured for division into two separate product display cases, comprising:

a) left and right lower front panels separated from one another by a shaped front notch;

b) left and right bottom panels respectively foldably connected to the left and right lower front panels along a lower front horizontal fold line and separated from one another along a bottom vertical perforation line, wherein the shaped front notch extends beyond the lower front horizontal fold line into the left and right bottom panels;

c) left and right lower rear panels respectively foldably connected to the left and right bottom panels along a lower rear horizontal fold line and separated from one another along a lower rear vertical perforation line, wherein the bottom vertical perforation line continuously extends from an apex of the shaped front notch to the lower rear vertical perforation line;

d) an upper rear panel separably connected to the left and right lower rear panels along a shaped upper rear cut line;

e) a top panel foldably connected to the upper rear panel along an upper rear horizontal fold line; and f) an upper front panel foldably connected to the top panel along an upper front horizontal fold line, wherein the upper front panel has a front recessed access area formed in an upper edge thereof, wherein the recessed area aligns with the shaped front notch to form an opening.

2. The blank as recited in claim 1, wherein the upper rear panel, the top panel and the upper front panel are adapted and configured to be separated from the left and right lower front panels, the left and right bottom panels and the left and right lower rear panels along the shaped upper rear cut line associated with the upper rear panel.

3. The blank as recited in claim 2, wherein the left lower front panel, the left bottom panel and the left lower rear panel are adapted and configured to be divided from the right lower front panel, the right bottom panel and the right lower rear panel along the bottom vertical perforation line and the lower rear vertical perforation line to form two separate product display cases.

4. The blank lank as recited in claim 1, wherein the left and right lower front panels have respective left and right lower front side flaps foldably connected thereto.

5. The blank as recited in claim 1, wherein the left and right bottom panels have respective left and right bottom side flaps foldably connected thereto.

6. The blank as recited in claim 1, wherein the left and right lower rear panels have respective left and right lower rear side flaps foldably connected thereto.

7. The blank as recited in claim 6, wherein the upper rear panel has left and right upper rear side flaps foldably connected thereto.

8. The blank as recited in claim 7, wherein the left and right upper rear side flaps are separated from the left and right lower rear side flaps by continuations of the shaped upper rear cut line associated with the upper rear panel.

9. The blank as recited in claim 1, wherein the top panel has left and right top side flaps foldably connected thereto.

10. The blank as recited in claim 1, wherein the upper front panel has left and right upper front side flaps foldably connected thereto.

11. The blank as recited in claim 1, wherein the shaped front notch extends from respective upper front edges of left and right lower front panels beyond the lower front horizontal fold line.

12. A retail ready package configured for division into two separate product display cases, comprising:

a) left and right lower front panels separated from one another by a shaped front notch;

b) left and right bottom panels respectively foldably connected to the left and right lower front panels along a lower front horizontal fold line and separated from one another along a bottom vertical perforation line, wherein the shaped front notch extends beyond the lower front horizontal fold line and into the left and right bottom panels;

c) left and right lower rear panels respectively foldably connected to the left and right bottom panels along a lower rear horizontal fold line and separated from one another along a lower rear vertical perforation line, wherein the bottom vertical perforation line continuously extends from an apex of the shaped front notch to the lower rear vertical perforation line;

d) an upper rear panel separably connected to the left and right lower rear panels along a shaped upper rear cut line;

e) a top panel foldably connected to the upper rear panel along an upper rear horizontal fold line; and f) an upper front panel foldably connected to the top panel along an upper front horizontal fold line, wherein the upper front panel has a front recessed access area formed in an upper edge thereof, wherein the recessed area aligns with the shaped front notch to form an opening.

13. The retail ready package as recited in claim 12, wherein the upper rear panel, the top panel and the upper front panel are adapted and configured to be separated from the left and right lower front panels, the left and right bottom panels and the left and right lower rear panels along the shaped upper rear cut line associated with the upper rear panel.

14. The retail ready package as recited in claim 13, wherein the left lower front panel, the left bottom panel and the left lower rear panel are adapted and configured to be divided from the right lower front panel, the right bottom panel and the right lower rear panel along the bottom vertical perforation line and the lower rear vertical perforation line to form two separate product display cases.

15. The retail ready package as recited in claim 13, wherein two rows of products are arranged side-by-side within the package in a vertical front facing display orientation relative to the left and right lower front panels of the package.

16. The retail ready package as recited in claim 12, wherein the shaped front notch extends from respective upper front edges of left and right lower front panels beyond the lower front horizontal fold line.

* * * * *